United States Patent [19]

Wood et al.

[11] Patent Number: 4,907,426

[45] Date of Patent: Mar. 13, 1990

[54] METHOD AND APPARATUS FOR WASHING A POROUS MAT

[75] Inventors: Robert F. Wood, Portland, Oreg.; William R. Vanderveer, Vancouver, Wash.

[73] Assignee: Fabcon, Inc., San Francisco, Calif.

[21] Appl. No.: 95,743

[22] Filed: Sep. 11, 1987

[51] Int. Cl.[4] ..... D06B 1/04

[52] U.S. Cl. ..... 68/200; 118/407; 210/217; 162/60

[58] Field of Search ..... 68/200; 210/209, 216, 210/217; 118/407; 239/379; 162/60, 310, 380

[56] References Cited

U.S. PATENT DOCUMENTS

| | | | |
|---|---|---|---|
| 2,439,802 | 4/1948 | Francis, Jr. | 118/407 X |
| 4,205,541 | 6/1980 | Zucker . | |
| 4,222,342 | 9/1980 | Jonansson | 118/407 X |
| 4,275,683 | 6/1981 | Kutz et al. | 118/407 |
| 4,427,491 | 1/1984 | Radvan et al. | 118/407 X |
| 4,522,716 | 6/1985 | LaValley . | |
| 4,563,244 | 1/1986 | Syed et al. | 118/407 X |
| 4,616,489 | 10/1986 | Wood et al. . | |

*Primary Examiner*—Frankie L. Stinson

*Attorney, Agent, or Firm*—Klarquist, Sparkman, Campbell, Leigh & Whinston

[57] ABSTRACT

A retainer maintains a body of standing washing liquid against the outside surface of a mat, such as a pulp mat. The mat moves on a vacuum screen which draws washing liquid from the body of liquid through the mat to clean it. The retainer pivots to adjust different mat heights and allows clumps of material on the mat to pass underneath the retainer. Clumps on the mat are also smoothed into the mat as the clumps pass underneath the retainer.

21 Claims, 3 Drawing Sheets

METHOD AND APPARATUS FOR WASHING A POROUS MAT

BACKGROUND OF THE INVENTION

1. Field of the Invention

This invention relates to washing systems wherein liquid is passed through a porous mat disposed on a screen over a vacuum head.

2. General Discussion of the Background

Various industrial processes require that a mass of porous material be washed in order to remove chemical or other impurities. For example, this need appears in the sugar industry, where sugar is washed from bagasse; in the textile industry where excess dyes are washed from fabric; in mining where impurities are washed from ore; and in the paper industry.

In a standard paper production line, wood chips are cooked with chemicals in aqueous solution, the precise composition of the cooking chemicals depending on the particular process and desired paper product. This step, normally carried out in a digester under heat and pressure, breaks down the wood by dissolving the organic compounds that hold the cellulose fibers together.

The mixture of pulp, spent cooking chemicals, and organic materials, collectively known as stock, is then fed to a series of washers. The most common type of washing system includes a rotary vacuum drum onto which the stock is spread as a mat. The drum has a cylindrical, porous outer surface, most commonly a screen. A negative pressure is maintained inside the drum, such that liquid in the mat is pulled into the interior of the drum and thereby separated from the pulp. A shower, which is disposed above the mat and extends axially along the drum, directs relatively clean liquid at and through the pulp mat to wash out chemical substances, dirt and organic solids. Typically in the brown stock area, there are three drums in sequence with wash liquid flowing from drum to drum countercurrently to the direction of the pulp movement. Each drum can have multiple showers to direct wash liquid at its pulp mat.

The final effluent from the drum washing operation is black liquor containing water, spent cooking chemicals, dirt and organic materials. Such liquor typically contains approximately 15% solid material, which must be separated from the water to allow reuse of the inorganic pulping chemicals in the liquor. Separation of the water and solids also reduces environmental problems when disposing of the liquor.

The solids and water are typically separated by an evaporation process in which the liquor passes through a series of evaporators. Within the evaporators, steam moves countercurrent to the liquor flow until the liquor is concentrated to a 60% solids content, at which point the liquor is burned in a boiler. The solid organic materials provide the fuel to generate steam for the evaporators, and inorganic chemicals smelt out the bottom of the boiler to be reused. The steam from the liquor recovery part of the cycle supplies most of the mill's steam needs.

It is apparent that the more dilute the liquor, the more energy must be expended in evaporating the water to recover the solids. At the same time, it is necessary to efficiently remove the chemicals from the pulp to provide a satisfactorily clean pulp. Thoroughly washing the mat improves the efficiency of chemical removal, but the large quantity of water typically required for thorough washing with existing showers forms a dilute liquor which requires a high expenditure of energy to separate water and solids.

One existing pulp mat shower is a weir constructed such that water flows between a pair of plates down onto and through the mat. Another type of shower is a whistle sprayer, which propels a stream of water under pressure towards the mat.

Yet another prior shower includes a shower pipe having a pair of diffusion flanges depending from the underside of the pipe. Each diffusion flange has a parabolic, concavely curved diffusion surface over which water flows from spray holes in the pipe to direct the water tangentially to the rotary drum. The diffusion flanges do not contact the surface of the mat being washed.

Existing showers which direct a stream of washing liquid towards a rotating mat are often unable to evenly distribute water across the drum. The mat is therefore washed unevenly across its width. Even the most efficient spray type showers give a less than uniform washing because the pulp mat is not of uniform thickness. Moreover, with spray type showers, some of the washing liquid does not move through the mat, but instead rolls down the drum and into the pulp vat, which increases water consumption, evaporation costs, and biological oxygen demand (BOD), while decreasing overall washing effectiveness.

Some of these problems were addressed by the Uniflow shower which is sold by Comarco Industrial, Inc., of Beaverton, OR. This shower, which is disclosed in U.S. Pat. Nos. 4,205,541 and 4,616,489, includes an elongated chamber placed axially above the drum. The lower portion of the chamber is narrow and structured such that a head of liquid builds up within the chamber to create a static liquid pressure which forces liquid to leave the chamber through a slot along its bottom. The head within the chamber, in combination with the vacuum inside the drum, causes liquid to flow out of the slot and through the pulp mat. Additionally, a pair of resilient skirts are attached to the slot and extend to the mat to guide the water perpendicularly to the mat and form somewhat of a seal between the mat and skirts, thus helping force water through the mat. Also, depending on the location at which the Uniflow shower is mounted, water can collect between one of the flexible skirts and the mat surface to form a standing puddle that extends across the width of the mat to facilitate even washing.

Although the Uniflow shower increases efficiency and evenness of washing by allowing a standing body of water to form on the surface of the mat, other problems may be created by the skirts contacting the mat surface. The Uniflow skirts are resilient, but they may disturb the pulp mat if the pulp mat is delicate due to low pulp consistency or density. Moreover, clumps on the surface of the mat may sometimes be knocked back into the vat. Preferably, all clumps should be smoothed into the surface of the mat.

The extremely corrosive chemicals used to make paper present another problem. Any device for washing a pulp mat must be constructed to withstand the rigors of this corrosive environment. Elastomeric skirts which are flexible enough to accommodate widely varying mat heights and pulp clumps are subject to chemical attack and must be frequently replaced.

It is accordingly an object of the present invention to provide a shower with an assembly for removing chemicals from a mat without disturbing the pulp mat.

Another object is to provide such an assembly which can be retrofitted to existing showers.

It is yet another object of the invention to avoid improper or random distribution of washing fluid over the width of the pulp mat.

Yet another object of the invention is to decrease water consumption, evaporation costs, and biological oxygen demand in a paper washing process.

Even yet another object of the invention is to provide a shower apparatus which is capable of accommodating varying mat heights and clumps of material on the mat, while being able to endure exposure to corrosive chemicals.

Also, it is an object of the invention to provide such a shower which automatically compensates for varying pulp mat thicknesses or clumps of pulp riding on the pulp mat.

SUMMARY OF THE INVENTION

The foregoing and other objects are achieved by use of a liquid retainer which is attached to a source of washing liquid above a mat on a moving screen filter. The retainer has a distal edge positioned to ride on the mat to deter liquid from flowing backward between the distal edge and the mat. The retainer thereby maintains a body of standing washing liquid in contact with the outside surface of the mat. A hinge permits the retainer to pivot such that the distal edge forms a floating seal with the mat that allows the retainer to compensate for uneven mat thickness or the presence of clumps of pulp on the mat.

The retainer is preferably made of a molded material such as fiberglass which is substantially inflexible and resists the corrosive action of chemicals in its environment. The hinge is preferably a piece of flexible fabric coated with Teflon polymer.

In preferred embodiments, a stop member prevents the distal edge of the retainer from moving oppositely of the direction of the drum's rotation beyond a preselected point.

The retainer is easily attached to existing showers, such as Uniflow, weir, and whistle showers.

The foregoing and other objects, features, and advantages of the invention will become more apparent from the following detailed description of several preferred embodiments which proceeds with reference to the accompanying drawings.

DETAILED DESCRIPTION OF PREFERRED EMBODIMENTS

The present invention aids in the washing of chemicals and other substances out of a mat by maintaining a body of standing washing liquid in contact with the outside surface of the mat. The mat is typically disposed on a porous moving surface, such as a screen, over a vacuum head, such as provided by a rotary vacuum drum.

Figure 1:
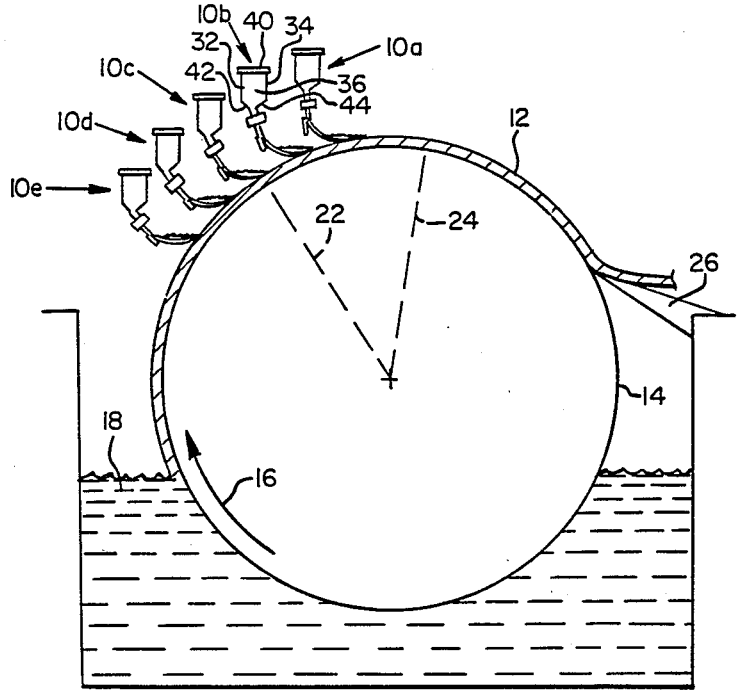
FIG. 1 is a schematic sectional view showing retainers of the present invention in use with several showers above a rotating drum in a paper production line.

FIG. 1 shows five showers 10*a*, 10*b*, 10*c*, 10*d*, and 10*e* positioned above a wood pulp mat 12 which is formed on a rotary vacuum drum 14 that rotates about a horizontal axis in the direction of arrow 16. Stock, which includes pulp, spent cooking chemicals, dirt and water, is continuously fed from a digester (not shown) into a vat where it forms a pool 18 in which drum 14 is partially submerged. Drum 14 has a perforated outer shell through which a partial vacuum inside the drum is communicated to the outside. As drum 14 rotates, pulp mat 12 forms on the outside of the drum and liquid is withdrawn by the vacuum into the drum.

At a position generally near the top of the drum, the mat passes under showers 10*a*, 10*b*, 10*c*, 10*d*, and 10*e* which remove chemical impurities. To simplify the description, only one shower 10*b* is described in detail, the other washers being structurally similar. Shower 10*b* is shown situated above drum 14 at approximately 30° before top center, as indicated by dashed line 22.

The vacuum between mat 12 and drum 14 is released at a position indicated by dashed line 24 which is approximately 10° past top center. Subsequently, the pulp mat separates from the rotating drum. The separation of the mat from the drum is accomplished by a doctor blade 26, which may either be a mechanical device or a linear array of nozzles directing pressurized air upwardly underneath the mat.

Shower 10 is preferably a Uniflow shower, such as the one shown in U.S. Pat. No. 4,616,489, the disclosure of which is incorporated by reference. As described in that patent, shower 10*b* includes an elongated chamber defined by sidewalls 32, 34 which extend axially with respect to drum 14, end walls 36 (only one of which is shown), top 40, and inwardly sloping bottom panels 42, 44. Sloping panels 42, 44 are angled toward one another but terminate before they meet, therefore defining an elongated slot 48 extending axially along the bottom of the chamber. Each of sloping panels 42, 44 is respectively provided with a flange 50, 52 (FIGS. 2 and 9) which extends along the length of the sloping panel and depends downwardly towards mat 12.

Figure 9:
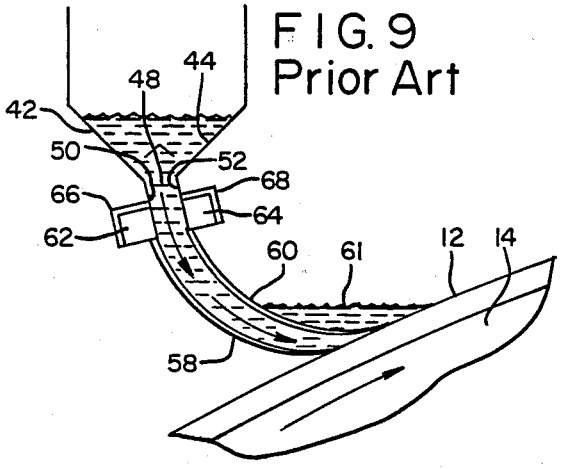
FIG. 9 Prior Art
FIG. 9 is a schematic sectional view of a prior art Uniflow shower.

In the Uniflow shower shown in FIG. 9, resilient skirts 58 and 60 are respectively attached along a proximal edge to each of flanges 50, 52 and extend downwardly such that a distal edge of each skirt 58, 60 contacts pulp mat 12 to form somewhat of a seal across the width of mat 12 and allow a standing body of water 61 to collect on the surface of the mat. Each skirt 58, 60 has an enlarged upper portion 62, 64 which is surrounded by and slides within complementary brackets 66, 68 mounted on flanges 50, 52.

Figure 2:
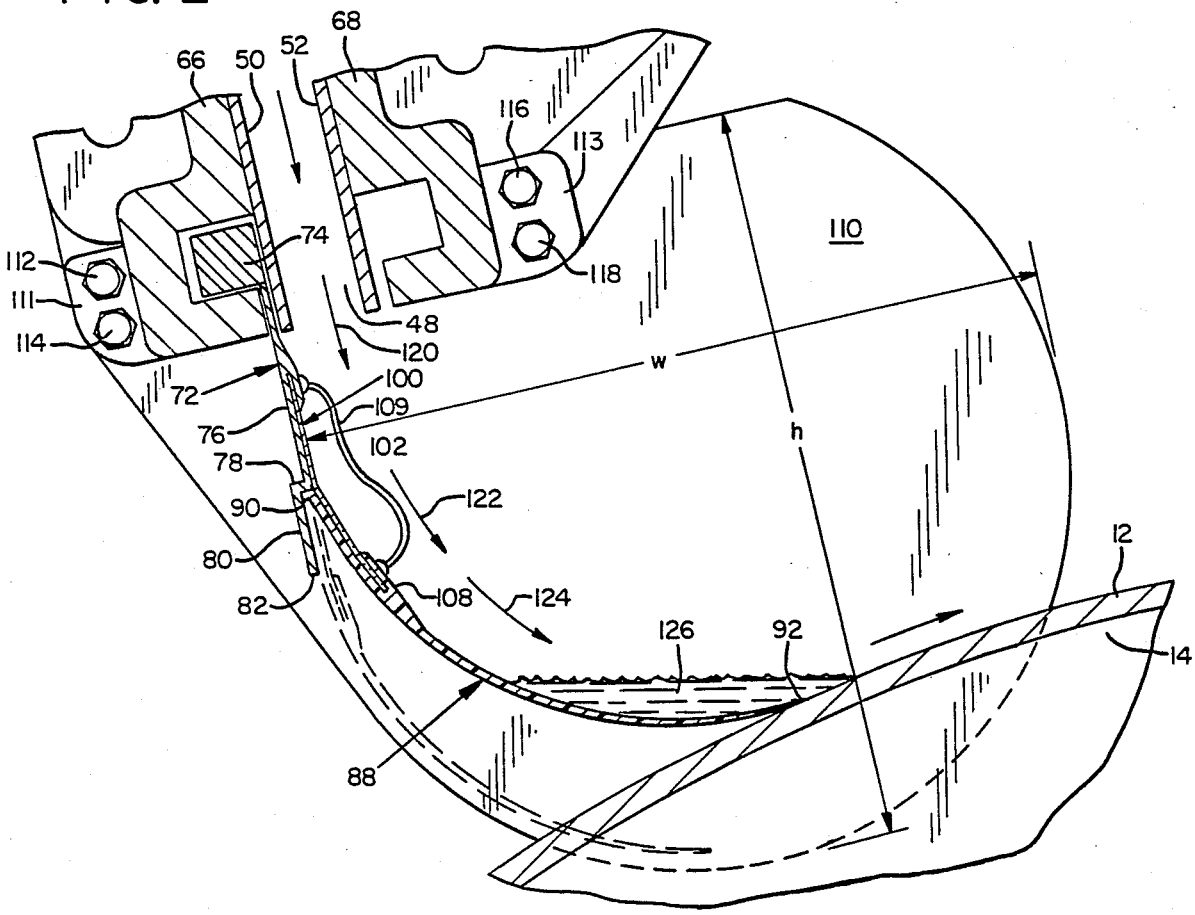
FIG. 2 is an enlarged, sectional view of a retainer shown in FIG. 1, phantom lines illustrating the position of the retainer in a relaxed condition and the position of an end plate which extends along an end face of the drum.
Figure 10:
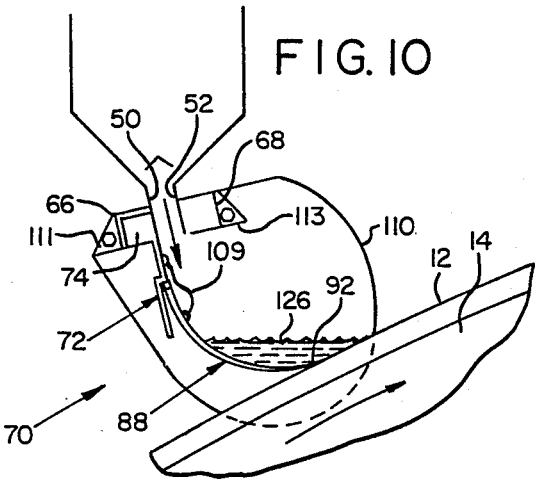
FIG. 10 is a schematic sectional view of the retainer of the present invention in use with the UNIFLOW shower of FIG. 9.
Figure 11:
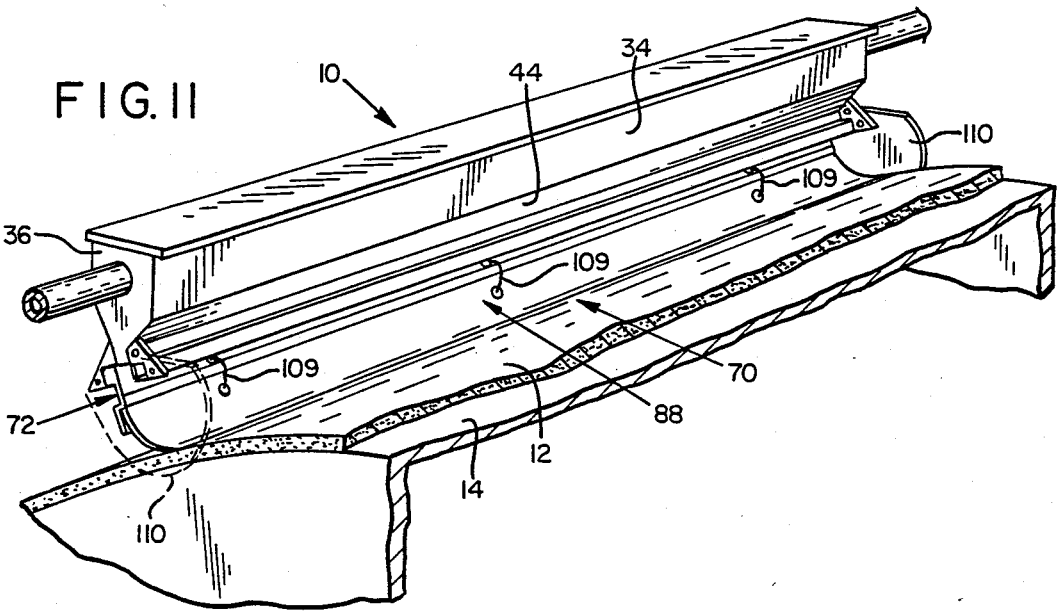
FIG. 11 is a partial isometric view showing one of the showers and a portion of the drum of FIG. 1.

As seen best in FIGS. 2, 10 and 11, a Uniflow shower is modified in the present invention by replacing skirt 58 with a liquid retention assembly 70 that extends the width of mat 12, and removing skirt 60 altogether. Assembly 70 includes a hinge mechanism and a concave fiberglass retainer 88. One part of the hinge mechanism is a stop member 72 which has an enlarged, square cross section upper lip 74 which slides into bracket 66 to hold member 72 in place, a plate 76 which extends downwardly toward mat 12, a short web segment 78 which extends perpendicular to plate 76, and a terminal flange segment 80 which is perpendicular to segment 78, parallel to plate 76, and has a bottom edge 82, which extends parallel to the axis of drum 14.

Retainer 88 is hingedly mounted to stop member 72 and can pivot between the positions shown in solid and phantom lines in FIG. 2. A proximal edge 90 of retainer 88 is attached to stop member 72 above its bottom edge 82, with proximal edge 90 lying alongside terminal segment 80. When in the relaxed position shown in FIG. 3, the proximal edge 90 is adjacent and parallel to perpendicular segment 78. A distal edge 92 of retainer 88 rests on mat 12 and forms a floating seal which deters liquid from flowing backwardly between distal edge 92 and mat 12 into pool 18. The retainer 88 is generally concave, merging with the mat 12 in the direction of drum rotation.

As shown in FIG. 2, stop member 72 is mounted sufficiently above and far away from drum 14 that distal edge 92 of retainer 88 is below proximal edge 90 when the mat is being washed. This gives retainer 88 a downwardly tilted orientation which reduces the volume of liquid which must collect behind the retainer to establish contact between the liquid and mat.

The hinge mechanism also includes a flexible, substantially watertight joint which is a piece of fabric 100 which pivotally interconnects stop member 72 with retainer 88. The fabric is a sheet 102 of woven glass fabric coated with Teflon (polytetrafluoroethylene) polymer. A suitable hinge fabric is Belt Chemglass 1544 from Chemical Fabrics Corp. of North Bennington, Vt 05257. A top margin 103 (FIGS. 3 and 4) of sheet 102 extends across plate 76 and is secured to plate 76 by a fiberglass portion 104 which is molded with margin 103 in place. The margin 103 is perforated so as to be most firmly embedded in the fiberglass. A bottom margin 106 of sheet 102 is similarly perforated and embedded between the main body of retainer 88 and a concave fiberglass portion 108 which is molded with margin 106 in place and extends across the concave face of retainer 88. The margins 103, 106 could be secured in other ways, but embedding is believed to provide the most secure, watertight connection. Each of a plurality of safety cords 109 has opposite ends connected to stop member 72 and retainer 88 such that retainer 88 will not fall against other washers 10*c*—10*e* or into pool 18 if fabric 100 breaks.

To deter liquid from flowing out of a body of standing water behind concave retainer 88, an end wall 110 is mounted at each end of washer 10*b*. In the embodiment of FIGS. 2, 10 and 11, each end wall is fixed with fasteners 112, 114, 116, 118 to a pair of mounting plates 111, 113 that are welded to brackets 66, 68. Other types of end walls are discussed below. Each end wall 110 extends downwardly a distance h (FIG. 2) such that a bottom portion of the end wall abuts a flat side face of drum 14 to deter liquid from flowing out from behind retainer 88 at the ends of the drum. Each end wall 110 projects forwardly a distance w from stop member 72. Preferably, the distance w is sufficient that distal edge 92 of retainer 88 will never project beyond wall 110 as the retainer pivots up and down around hinge 100. Each wall 110 extends rearward a sufficient distance that retainer 88 still contacts wall 110 even when the assembly is raised to the extent that the retainer is in the fully relaxed position shown in phantom in FIG. 2. The side edges of retainer 88 abut end wall 110 tightly enough to deter the flow of liquid between retainer 88 and end wall 110, while leaving enough clearance to permit retainer 88 to pivot about hinge 100 relative to end wall 110. The pulp mat 12, assembly 70 and end walls 110 thus together define a trough which retains a pool of liquid at a desired location on the mat.

In operation, liquid in washer 10*b* flows from between flanges 50, 52 in the direction indicated by arrows 120, 122, and 124 to collect behind retainer 88 between its end walls 110 and form a body of standing liquid 126 which is sufficiently deep to rise above distal edge 92 and contact the outside surface of mat 12 across its width. The flow of liquid from washer 10 is regulated such that the vacuum in drum 14 draws liquid 126 through mat 12 at a rate sufficient to maintain the depth of the body of liquid 126 at a substantially constant level above distal edge 92. The prolonged contact between body of liquid 126 and mat 12 increases the efficiency of washing by ensuring an even distribution of washing liquid across mat 12. Liquid is constantly drawn through the mat to wash chemicals out of it.

If mat 12 is uneven, retainer 88 pivots about hinge fabric 100 to accommodate irregularities in thickness of mat 12 while retaining the body of liquid 126 at a substantially constant depth. If clumps of material are present on mat 12, distal edge 92 of retainer 88 rides over and smoothes the clumps into the surface of mat 12.

Figure 3:
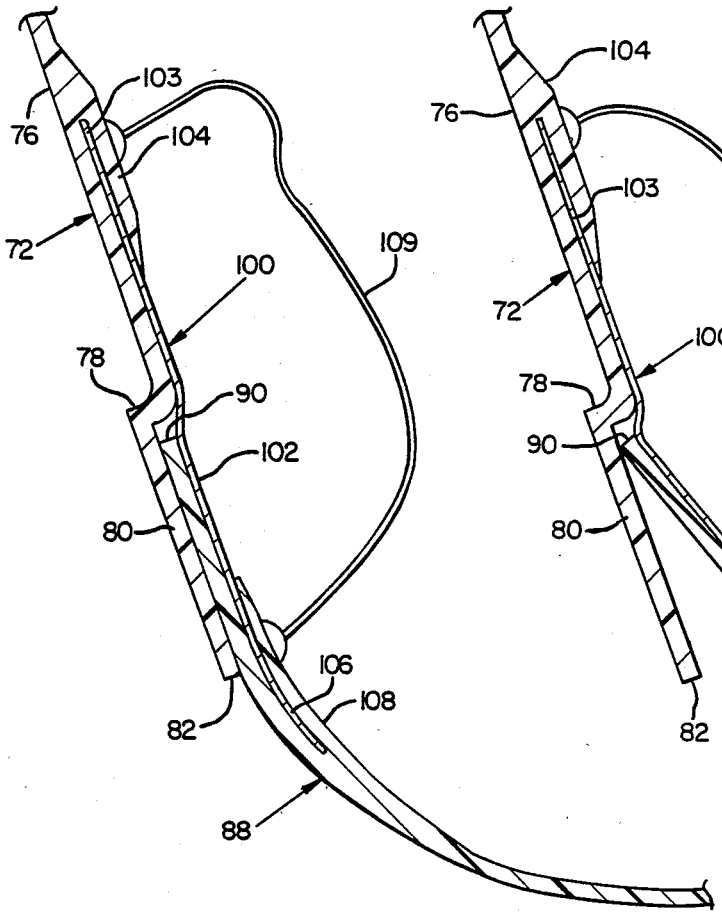
FIG. 3 is an enlarged, sectional view of the hinge for the retainer shown in FIG. 2, the retainer being in a relaxed position.
Figure 4:
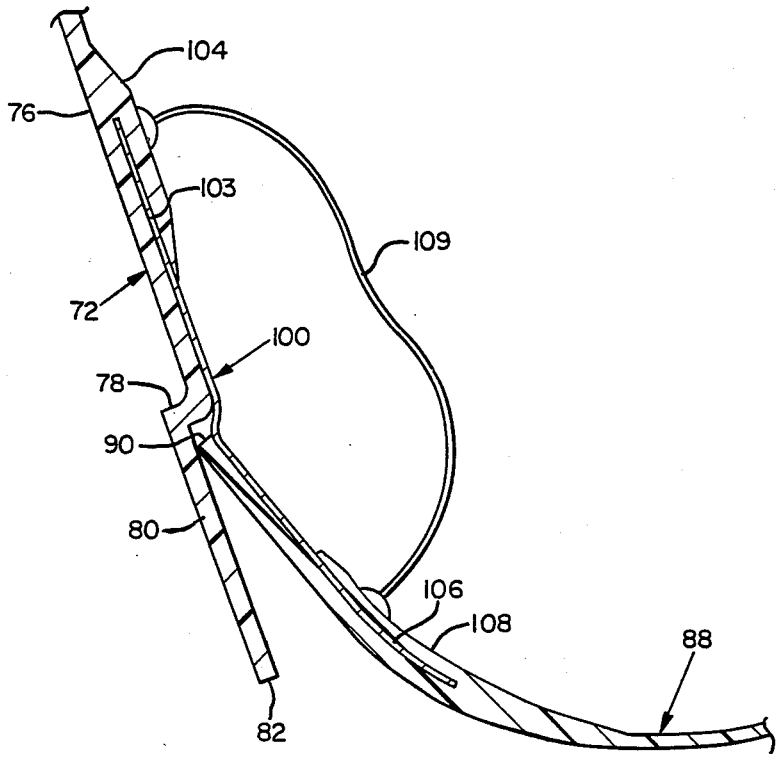
FIG. 4 is a view similar to FIG. 3, the hinge being flexed.

The pivoting action of the hinge mechanism is illustrated in FIGS. 3 and 4. FIG. 3 shows retainer 88 in a fully relaxed position with the upper portion of retainer 88 resting flat against segment 80 of stop member 72. Retainer 88 is free to move to the position shown in FIG. 4 wherein the flat wall of retainer 88 has moved away from terminal segment 80 by flexing hinge fabric 100. Retainer 88 moves to the position shown in FIG. 4, for example, to accommodate the varying thickness of a mat 12 beneath it. If mat 12 becomes thicker or contains any surface irregularities, such as clumps, retainer 88 will pivot upwardly an additional distance.

FIG. 3 illustrates that terminal segment 80 of stop member 72 provides a limit which stops the distal edge of the retainer 88 from moving beyond a preselected point in a direction opposite the direction of rotation of drum 14. This prevents retainer 88 from pivoting backwards and dumping the body of water 126 from the retainer.

Other Embodiments

FIGS. 5–10 show how the retainer can be adapted for placement on several existing pulp showers.

Figure 5:
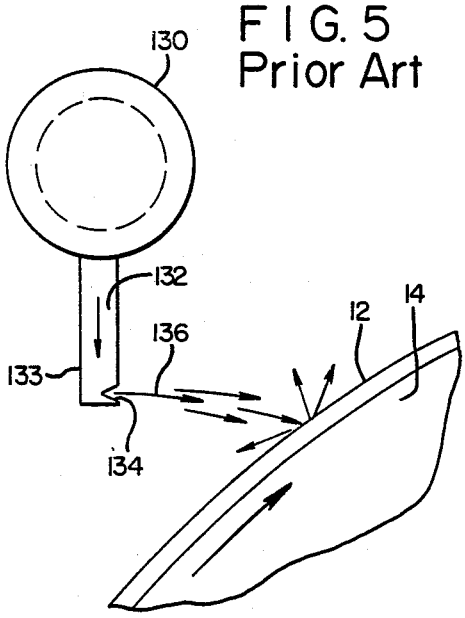
FIG. 5 Prior Art
FIG. 5 is a schematic sectional view of a prior art whistle shower.

A prior art whistle shower is shown in FIG. 5 to include a manifold 130 which feeds washing liquid through an elongated chamber 132 defined by a conduit 133 to a slot 134 along the front face of the chamber. The pressure of liquid within chamber 132 forces the liquid out of slot 134 and directs it in a stream 136 at mat 12. Some of the liquid in stream 136 passes through mat 12 to clean it, but the remainder of the liquid is deflected away from the surface of mat 12 and rolls down mat 12 into the pulp vat.

Figure 6:
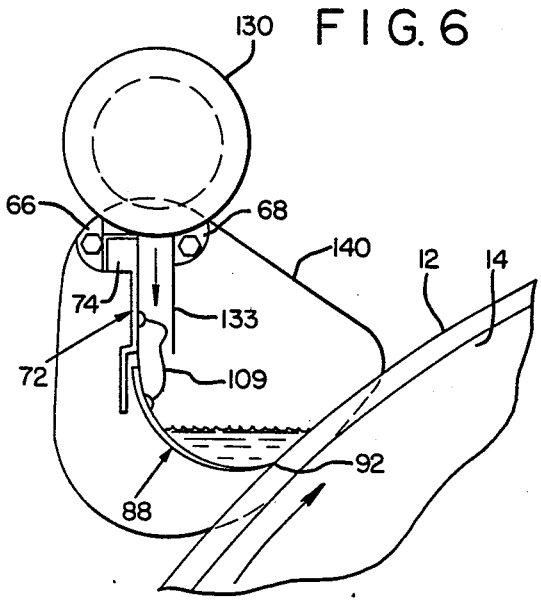
FIG. 6 is a schematic sectional view of the retainer of the present invention in use with a modified version of the whistle shower shown in FIG. 5.

In FIG. 6, retainer 88 has been attached to the whistle shower to deter downflow of liquid from the drum into the pulp vat and improve washing efficiency. Brackets 66, 68 are welded to manifold 130, and enlarged lip 74 of stop member 72 slides into the receptacle formed by bracket 66. Retainer 88 pivots relative to stop member 72 along the fabric hinge (not shown in FIG. 6). An end wall 140 is rigidly attached to stop member 72 at each end of manifold 130. The mat 12, retainer 88 and end walls 140 together form a trough that allows a body of standing liquid to collect behind retainer 88 as drum 14 rotates. End wall 140 extends toward the surface of drum 14 to about the bottom of mat 12. As shown in FIG. 6, the lower end of the conduit 133 may be removed since spraying through a slot is no longer advantageous.

Figure 7:
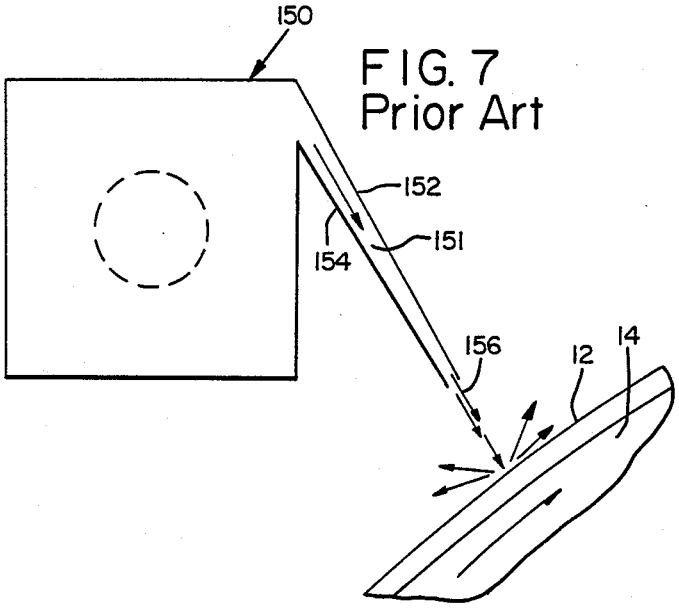
FIG. 7 Prior Art
FIG. 7 is a schematic sectional view of a prior art weir shower.
Figure 8:
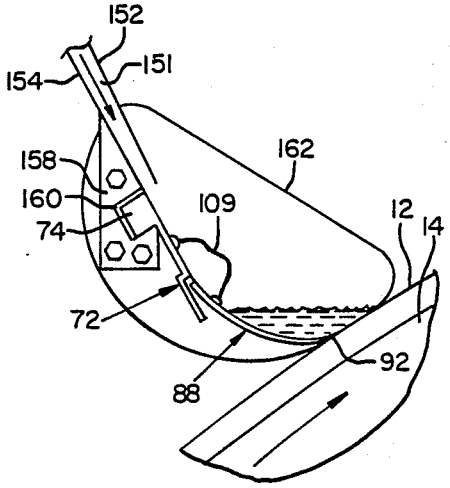
FIG. 8 is a schematic sectional view of the retainer of the present invention in use with the weir shower of FIG. 7.

FIG. 7 shows a prior art weir shower 150 in which washing liquid collects until it flows down a passageway 151 between top and bottom plates 152, 154. A stream of washing liquid 156 flows out of passageway 151 in the direction of mat 12, but much of the liquid is deflected at the surface of the mat and flows down mat 12 into a pulp vat beneath the drum. The washing efficiency of the weir shower is improved, as shown in FIG. 8, by attaching a bracket 158 to bottom plate 154. Bracket 158 includes a slot 160 into which enlarged lip 74 of stop member 72 slides such that stop member 72 is parallel to plate 154 and forms an extension of it. Retainer 88 is attached to stop member 72 by a fabric hinge, and end walls 162 are rigidly attached to each edge of retainer 88 to form a closed trough with retainer 88 across the width of mat 12. The end walls 162 can be attached by glue, screws, or can be formed as integral parts of the retainer 88. The end walls 162 in this embodiment only extend down to about the level of the surface of mat 12. Washing liquid flowing through passageway 151 collects in the trough between walls 162 and rises above the level of distal edge 92 to contact mat 12 and wash it as drum 14 rotates.

Having illustrated and described the principles of the invention in preferred embodiments, it should be apparent to those skilled in the art that the invention can be modified in arrangement and detail without departing from such principles. For example, the liquid retention assemblies described herein work equally well with washing systems that employ moving belt screens instead of rotary drums. We thus claim all modifications coming within the spirit and scope of the following claims.

We claim:

1. A liquid retention assembly for use with a shower disposed over a portion of a porous moving surface which bears a mat of material impregnated with chemicals, the assembly comprising:

a substantially rigid retainer with a distal edge positionable to rest on a mat of material on a porous moving surface to deter liquid from flowing between the distal edge and the mat for maintaining a body of washing liquid in contact with the outside surface of the mat; and hinge means a connectable between the shower and the retainer for permitting the retainer to pivot such that the distal edge is in floating contact with the mat

2. The assembly of claim 1 wherein the hinge means includes means for preventing the distal edge of the retainer from moving beyond a preselected position in a direction opposite a direction of movement of the screen.

3. The assembly of claim 1 wherein the hinge means comprises:

a stop member having a bottom edge; and a piece of flexible fabric interconnecting the stop member and the retainer.

4. The assembly of claim 3 wherein the retainer has a proximal edge that is hinged to the stop member above the bottom edge.

5. The assembly of claim 3 wherein the fabric is comprised of polytetrafluoroethylene fabric.

6. The assembly of claim 3 wherein:

the stop member and retainer are made of a moldable material; and the piece of fabric extends between and is embedded in the stop member and retainer.

7. The assembly of claim 6 wherein the proximal edge of the retainer is hinged to the stop member above the bottom edge of the stop member.

8. The assembly of claim 6 wherein the retainer comprises a concave panel of fiberglass.

9. The assembly of claim 3 further comprising a plurality of safety cords connected between the retainer and the stop member.

10. The assembly of claim 1 further comprising opposing end walls which, together with the pulp mat and the retainer, define a trough for retaining liquid.

11. A shower for removing chemicals and waste solids from a mat of material, the mat being disposed over a portion of a porous moving surface with an outside surface of the mat exposed, the shower comprising:

supply means for directing a washing liquid at the outside surface of the mat;

a substantially rigid retainer with a distal edge that rests on the mat to deter liquid from flowing between the distal edge and the mat for maintaining a body of washing liquid in contact with the outside surface of the mat across a width of the mat; and hinge means connectable between the shower and the retainer for permitting the retainer to pivot such that the distal edge is in floating contact with the mat.

12. The shower of claim 11 wherein the retainer has a proximal edge in fixed relation to the supply means, the proximal edge being higher than the distal edge.

13. The shower of claim 11 further comprising means for preventing the distal edge of the retainer from moving beyond a preselected position in a direction opposite a direction of movement of the screen.

14. The shower of claim 11 further comprising:

a stop member having a bottom edge; and a piece of flexible fabric interconnecting the stop member and the retainer.

15. The shower of claim 14 wherein the retainer has a bottom edge and a proximal edge, the proximal edge being hinged to the stop member above the bottom edge.

16. The shower of claim 14 wherein the fabric hinge is comprised of polytetrafluoroethylene fabric.

17. The shower of claim 14 wherein:

the stop member and retainer are made of a moldable material; and the piece of fabric extends between and is embedded in the stop member and retainer.

18. The shower of claim 17 wherein the retainer comprises a concave panel of fiberglass.

19. The shower of claim 14 further comprising a plurality of safety cords connected between the retainer and the stop member.

20. The shower of claim 11 further comprising opposing end walls which, together with the pulp mat and the retainer, define a trough for retaining liquid.

21. A shower for removing chemicals from a mat of material impregnated with chemicals, the mat being disposed over a portion of a porous moving surface with an outside surface of the mat exposed, the shower comprising:

liquid source means for directing a supply of washing liquid at the outside surface of the mat;

a substantially rigid, fiberglass stop plate mounted to the liquid source and projecting towards the mat across the width of the mat, the stop plate having a bottom edge; and a concave, substantially rigid, fiberglass retainer hingedly mounted to the stop plate, the retainer having a proximal edge mounted to the stop plate above the bottom edge, and a distal edge that rests on the mat to deter liquid from flowing between the distal edge and mat for maintaining a body of washing liquid in contact with the outside surface of the mat;

a fabric hinge comprising a polytetrafluoroethylene fabric sheet having a first edge embedded in the plate and a second edge embedded in the retainer;

a plurality of safety cords connected between the retainer and the stop member; and end walls fixedly mounted in relation to the stop member, the pulp mat, retainer and end walls together defining an arcuate trough.

* * * * *